US010967644B2

(12) United States Patent
Hirata et al.

(10) Patent No.: US 10,967,644 B2
(45) Date of Patent: Apr. 6, 2021

(54) EXTERIOR BODY, LIQUID STORAGE BODY UNIT AND LIQUID DISCHARGE APPARATUS

(71) Applicant: SEIKO EPSON CORPORATION, Tokyo (JP)

(72) Inventors: Kazuyuki Hirata, Matsumoto (JP); Yuji Aoki, Hara-mura (JP); Hiroshi Nose, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/658,656

(22) Filed: Oct. 21, 2019

(65) Prior Publication Data

US 2020/0122471 A1 Apr. 23, 2020

(30) Foreign Application Priority Data

Oct. 22, 2018 (JP) ..... JP2018-198384

(51) Int. Cl.
*B41J 2/175* (2006.01)

(52) U.S. Cl.
CPC .. *B41J 2/17513* (2013.01); *B41J 2002/17516* (2013.01)

(58) Field of Classification Search
CPC ..... B41J 2/175; B41J 2/17513; B41J 2002/17516
See application file for complete search history.

(56) References Cited

U.S. PATENT DOCUMENTS

2016/0288510 A1* 10/2016 Kumagai ..... B41J 2/17513

FOREIGN PATENT DOCUMENTS

JP 2016-137675 A 8/2016

* cited by examiner

*Primary Examiner* — Lamson D Nguyen
(74) *Attorney, Agent, or Firm* — Oliff PLC

(57) ABSTRACT

An exterior body for storing a liquid storage body including a first main film, a second main film, and a first side film that define an interior space containing a liquid, the first side film having a gusset portion having a fold, the exterior body including an outer shell that forms a storage space storing the liquid storage body, and a pressing portion that is provided in the outer shell, that presses the first side film, and that bend the gusset portion inward.

10 Claims, 5 Drawing Sheets

EXTERIOR BODY, LIQUID STORAGE BODY UNIT AND LIQUID DISCHARGE APPARATUS

The present application is based on, and claims priority from JP Application Serial Number 2018-198384, filed Oct. 22, 2018, the disclosure of which is hereby incorporated by reference herein in its entirety.

BACKGROUND

1. Technical Field

The present disclosure relates to an exterior body, a liquid storage body unit, and a liquid discharge apparatus.

2. Related Art

In general, a tray which can store a liquid storage body having a liquid storage portion is known (for example, JP-A-2016-137675). The liquid storage portion is formed in a bag shape with a flexible film material, and has a gusset portion that is recessed toward the inside. The tray has a side portion opposite to the gusset portion in a state of storing the liquid storage body. The side portion is provided with a projection portion projecting toward the gusset portion.

SUMMARY

In the related art, when an impact is applied from the outside of the tray due to falling of the tray or the like, the liquid storage portion stored inside the tray collides with the projection portion, and stress may be concentrated in a region where the gusset portion and the projection portion of the liquid storage portion are in contact with each other. In this case, the gusset portion of the liquid storage portion may be broken and the liquid may leak. In addition, a moving space of the gusset portion is formed inside the tray. Therefore, when the tray sways during transport or the like, the gusset portion may repeat bending to the inside and bending to the outside. In this case, the gusset portion may be broken due to fatigue due to repeated bending.

According to an aspect of the present disclosure, there is provided an exterior body for storing a liquid storage body including a first main film, a second main film, and a first side film that define an interior space containing a liquid, the first side film including a gusset portion having a fold, the first main film having a first main surface, the second main film having a second main surface, and the first main surface facing the second main surface via the liquid. The exterior body is provided with an outer shell that forms a storage space storing the liquid storage body, and a pressing portion that is provided in the outer shell, that presses the first side film by interposing the first and second main films from both sides, and that bend the gusset portion inward.

DESCRIPTION OF EXEMPLARY EMBODIMENTS

A. First Embodiment

Figure 1:
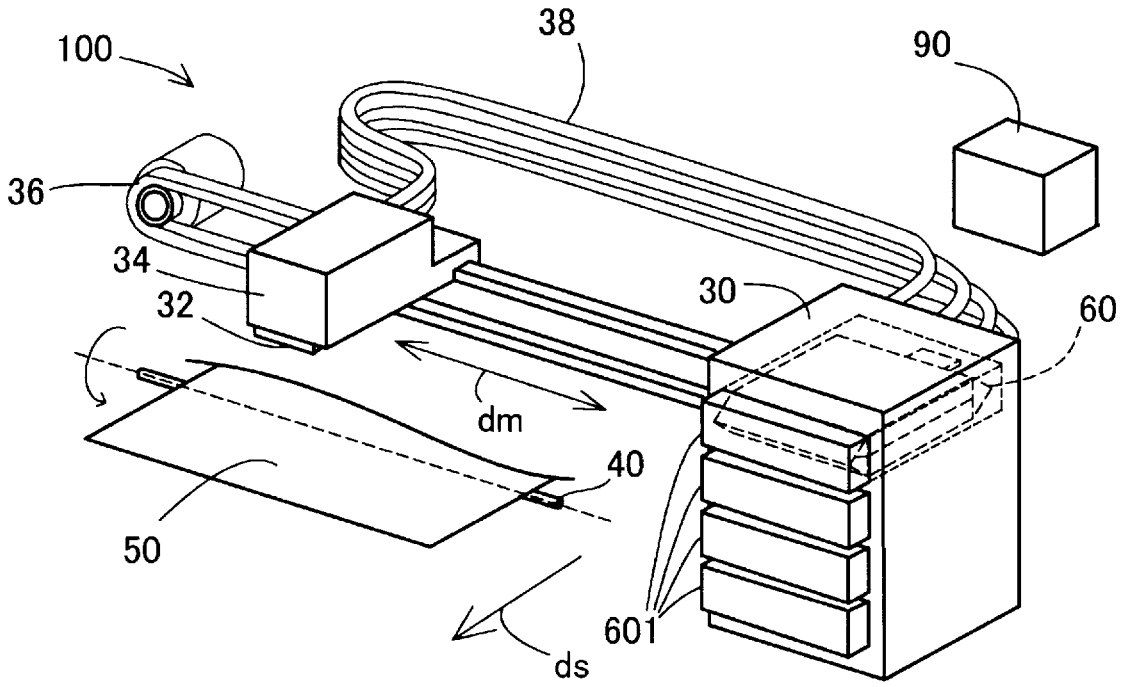
FIG. 1 is a schematic view of a liquid discharge apparatus.

FIG. 1 is a schematic view of a liquid discharge apparatus 100. The liquid discharge apparatus 100 is an apparatus that discharges a liquid to a medium 50 and holds the liquid on the medium 50. The liquid discharge apparatus 100 is a so-called ink jet printer, which discharges an ink as the liquid and performs printing on the medium 50. The medium 50 is a print medium such as a sheet, a plate, or a cloth. For example, an aqueous ink or a solvent ink can be used as the ink. In the present embodiment, the solvent ink is used as the ink.

The liquid discharge apparatus 100 is provided with a liquid storage body 60, an attachment portion 30 attaching the liquid storage body 60, a carriage 34 having a head 32 discharging the liquid to the outside, a drive mechanism 36, and a transport mechanism 40 transporting the medium 50, and a control portion 90. The drive mechanism 36 drives the carriage 34 in a main scanning direction dm. The transport mechanism 40 transports the medium 50 in a direction intersecting the main scanning direction dm, for example, in a sub-scanning direction ds which is a direction orthogonal thereto. The control portion 90 controls various operations of the liquid discharge apparatus 100, for example, a printing operation. The liquid discharge apparatus 100 is an off-carriage type ink jet printer. In the off-carriage type ink jet printer, the attachment portion 30 is not interlocked with the drive of the carriage 34.

The liquid storage body 60 is a container capable of containing liquid therein, and in the present embodiment, is a flexible bag-shaped ink pack. More specifically, the liquid storage body 60 is a gusset type ink pack formed by a plurality of film members. The attachment portion 30 has a space in which the liquid storage body 60 can be stored. The liquid storage body 60 is detachably attached to the attachment portion 30. In the present embodiment, the liquid storage body 60 is attached to the attachment portion 30 in a state of being stored in a liquid storage container 601. In the present embodiment, the liquid storage container 601 is a cartridge. The attachment portion 30 is attached with a tube 38 that enables the liquid to flow between the liquid storage body 60 stored inside and the head 32. The liquid discharge apparatus 100 may have a configuration in which the liquid storage body 60 not stored in the liquid storage container 601 can be directly attached to the attachment portion 30.

Figure 2:
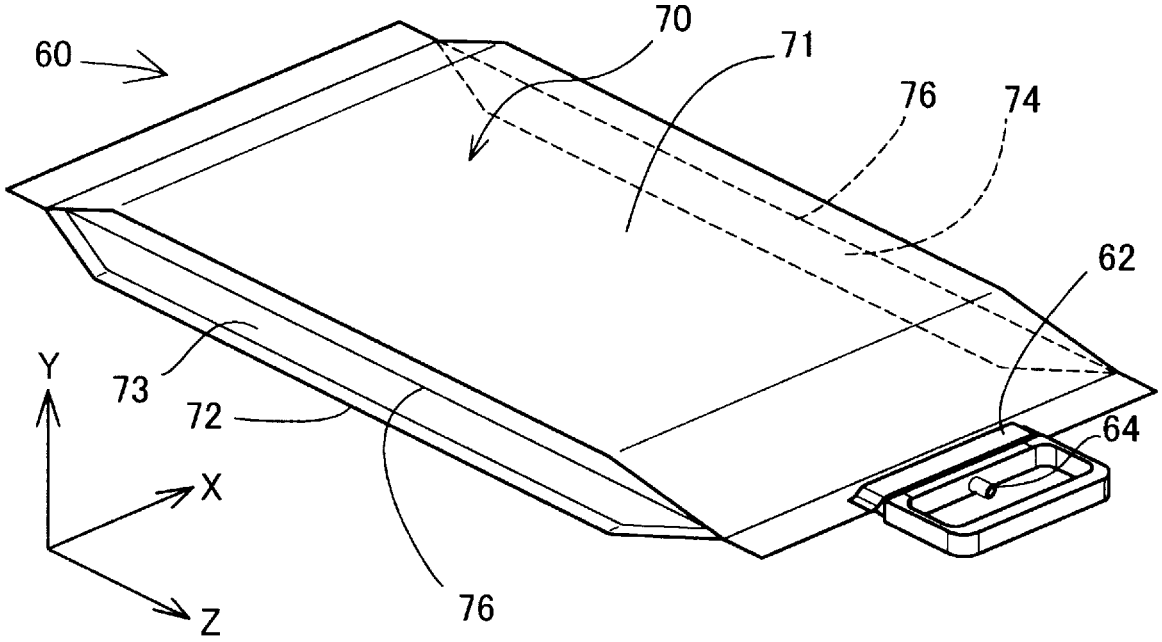
FIG. 2 is a perspective view of a gusset type liquid storage body.

FIG. 2 is a perspective view of the liquid storage body 60. The liquid storage body 60 has a liquid discharge portion 62 and a storage portion 70. The liquid discharge portion 62 is coupled to a liquid introduction needle of the liquid discharge apparatus 100 and has a liquid outlet 64 causing the liquid to flow out to the liquid discharge apparatus 100. In FIG. 2, an X axis, a Y axis, and a Z axis which are orthogonal to each other are displayed. An X direction, which is a direction along the X axis, is a width direction of the liquid storage body 60. A Y direction, which is a direction along the Y axis, is a thickness direction of the liquid storage body 60. A Z direction, which is a direction along the Z axis, is a depth direction of the liquid storage body 60. The X-axis, the Y-axis, and the Z-axis are displayed as necessary in FIG. 3 and later.

The storage portion 70 is formed of four flexible film members 71, 72, 73, and 74. An interior space of the storage portion 70 is defined by four film members 71 to 74. The four film members 71 to 74 are joined to each other by heat welding. Various resin films can be used as the film members 71 to 74. Specifically, for example, polyethylene films can be used. The four film members 71 to 74 are a pair of main films 71 and 72 facing each other in the Y direction, and a pair of side films 73 and 74 facing each other in the X direction. The main films 71 and 72 are films having a larger area than the side films 73 and 74, and define a main surface of the liquid storage body 60. The side films 73 and 74 define the side surfaces of the wall surfaces defining the interior space.

The side films 73 and 74 have a gusset portion 76 in which a fold is formed in advance. The gusset portion 76 is provided to extend along the Z direction at the central portion of the side films 73 and 74 in the Y direction. The side films 73 and 74 have a recessed shape that is bent inward along the gusset portion 76. In addition, the gusset portion 76 bends in accordance with the change in the amount of liquid in the liquid storage body 60.

In the liquid storage body 60, when an impact is applied to the liquid storage body 60 from the outside of an exterior body 80, the stress applied by the impact tends to be concentrated toward one end side and the other end side of the gusset portion 76 provided on the side films 73 and 74. In addition, when fatigue occurs due to repeated bending in the gusset portion 76, a larger fatigue tends to be accumulated toward one end side and the other end side of the side films 73 and 74.

Figure 3:
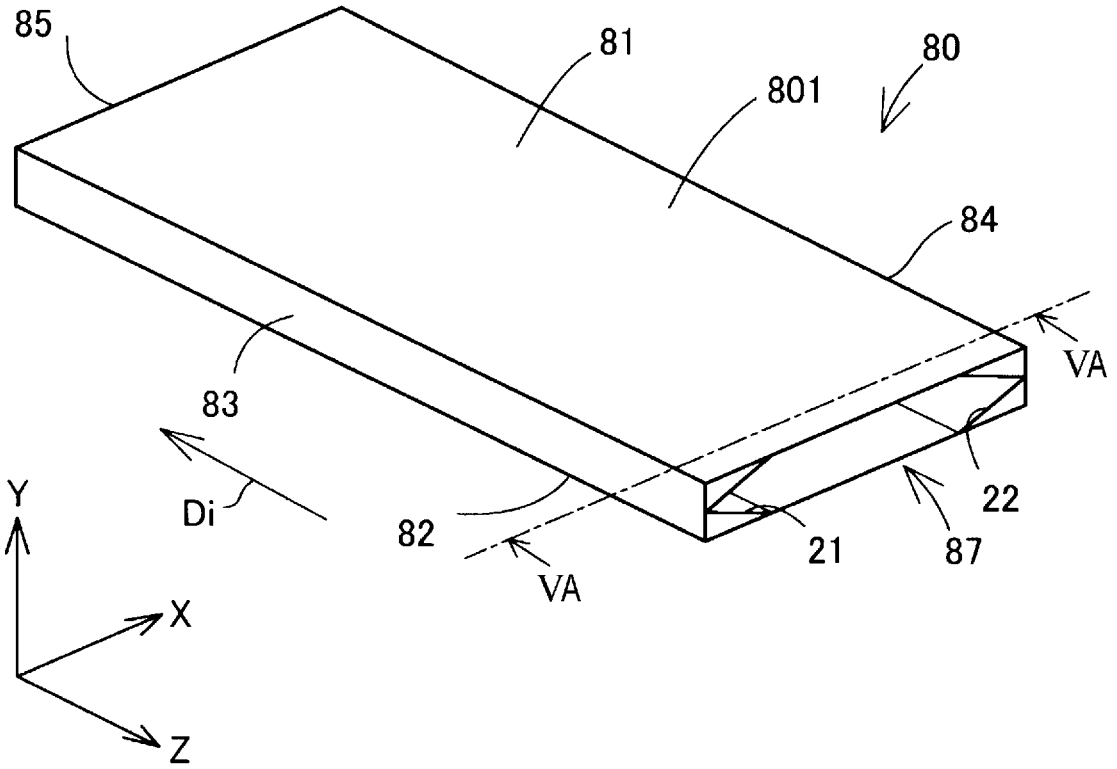
FIG. 3 is a schematic view illustrating an exterior body of the liquid storage body.
Figure 4A:
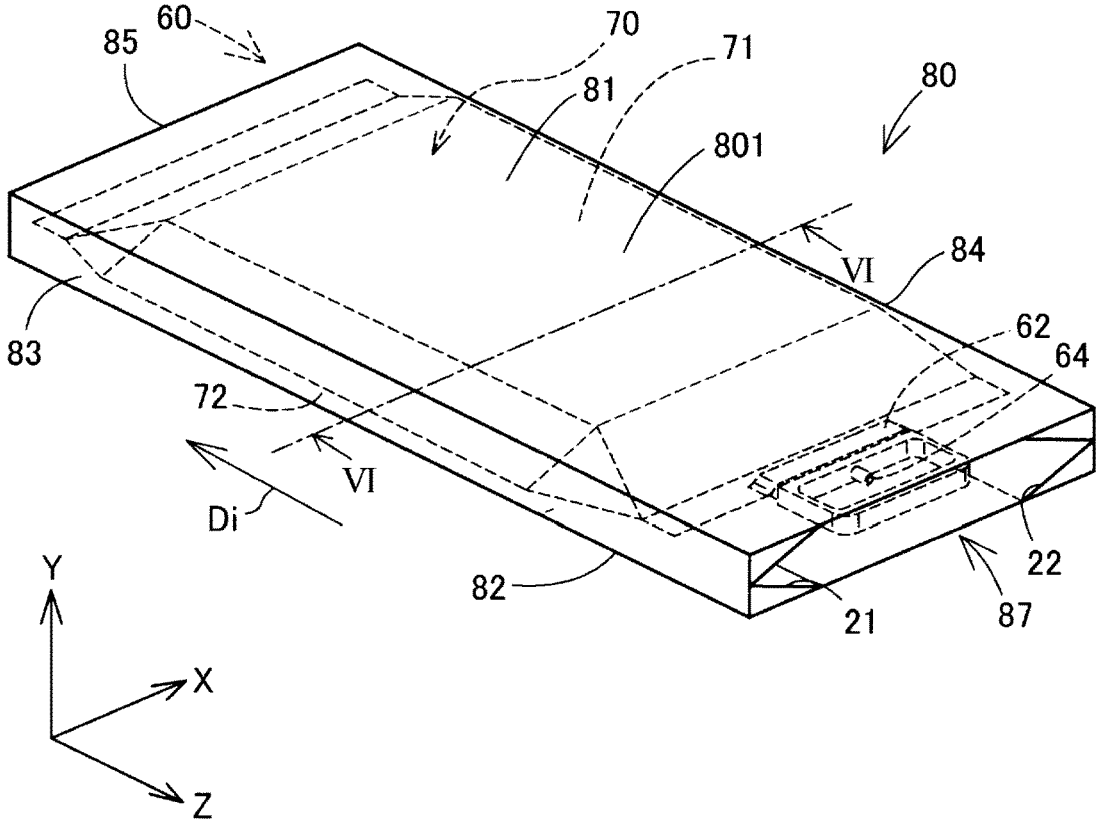
FIG. 4A is a schematic view illustrating the liquid storage body in a state of being stored in the exterior body.
Figure 4B:
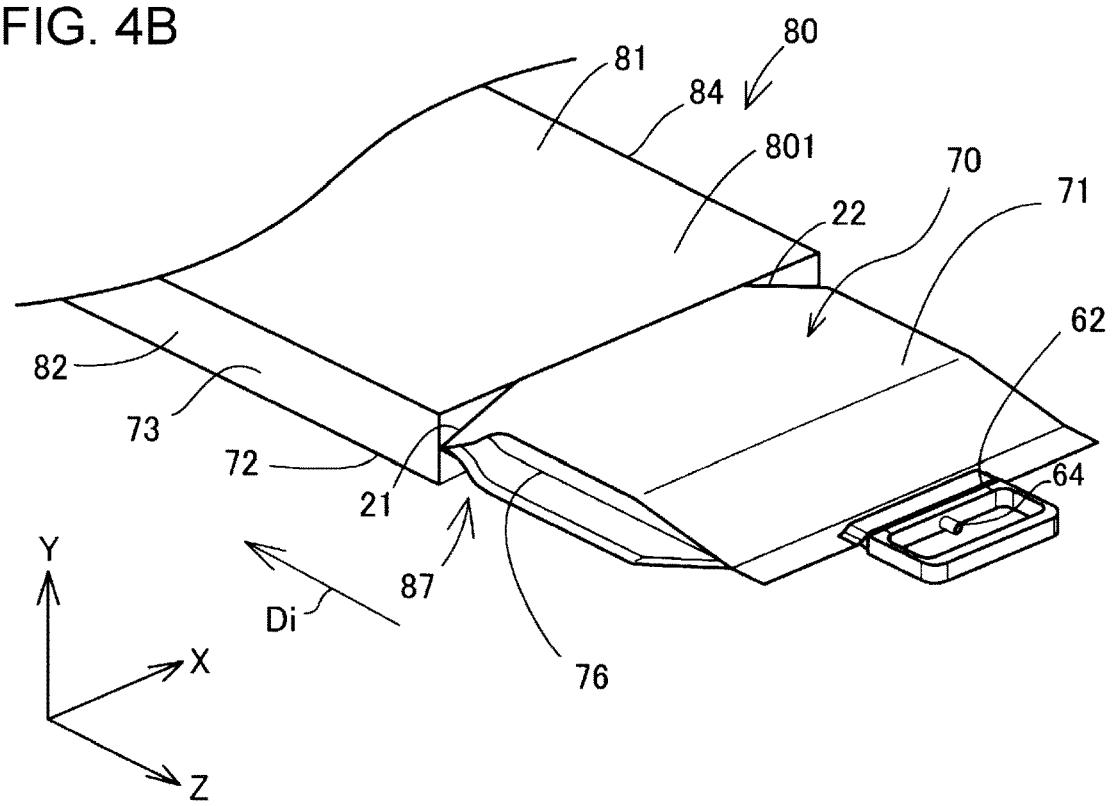
FIG. 4B is a schematic view illustrating a state in a process of storing the liquid storage body in the exterior body.

FIG. 3 is a schematic view illustrating the exterior body 80 of the liquid storage body 60. FIG. 4A is a schematic view illustrating the liquid storage body 60 in a state of being stored in the exterior body 80. FIG. 4B is a schematic view illustrating a state where the liquid storage body 60 is being stored in the exterior body 80. In FIG. 4A, the exterior body 80 is illustrated by a solid line, and the liquid storage body 60 is illustrated by a broken line. Similar to FIG. 2, FIG. 3 illustrates the X axis, the Y axis, and the Z axis. The X direction is the width direction of the exterior body 80. The Y direction is the thickness direction of the exterior body 80. The Z direction is the depth direction of the exterior body 80. In the present embodiment, the width direction, the thickness direction, and the depth direction in the liquid storage body 60 coincide with the width direction, the thickness direction, and the depth direction in the exterior body 80.

The exterior body 80 stores the liquid storage body 60 inside when transporting the liquid storage body 60 or the like, and protects the liquid storage body 60 from an impact or the like applied from the outside. As the exterior body 80, various materials such as paper and resin can be used. In the present embodiment, the exterior body 80 is formed using paper. More specifically, the exterior body 80 is formed using a cardboard. When the cardboard is used as the material of the exterior body 80, a cost at the time of manufacturing, for example, a material cost or a processing cost is reduced as compared with the case where other materials such as resin are used. In addition, when the cardboard is used, the environmental burden at the time of manufacture and disposal is also reduced. The liquid storage body 60 is set in the liquid storage container 601 after being taken out from the exterior body 80, and is further attached to the liquid discharge apparatus 100.

The exterior body 80 is provided with a main body portion 801 and two pressing portions 21 and 22 disposed inside the main body portion 801. The main body portion 801 has a substantially rectangular parallelepiped shape. The main body portion 801 has an opening portion 87 for inserting the liquid storage body 60 inside. The opening direction of the opening portion 87 is the Z direction. In FIG. 3, FIG. 4A, and FIG. 4B, an insertion direction Di of the liquid storage body 60 is illustrated by the arrow. The insertion direction Di substantially coincides with the Z direction which is the depth direction of the liquid storage body 60 when the liquid storage body 60 is stored in the exterior body 80. The main body portion 801 has walls 81 to 85 which are outer shells forming an interior space of the exterior body 80. The walls 81 to 85 are also referred to as a first wall 81, a second wall 82, a third wall 83, a fourth wall 84, and a fifth wall 85, respectively. The first wall 81 to the fourth wall 84 extend in the direction along the insertion direction Di. The fifth wall 85 extends in a direction intersecting the insertion direction Di.

The first wall 81 defines a top surface which is a wall surface on the +Y direction side among the wall surfaces forming the interior space of the exterior body 80. The first wall 81 forms one of the main surfaces of the exterior body 80. The second wall 82 is disposed at a position opposed to the first wall 81 in the Y direction, and defines a bottom surface among the wall surfaces forming the interior space of the exterior body 80. The second wall 82 forms the other main surface of the exterior body 80. As illustrated in FIGS. 4A and 4B, the first wall 81 faces one of the main films 71 of the liquid storage body 60 in a state where the liquid storage body 60 is stored inside. In addition, the second wall 82 faces the main film 72. In the present embodiment, the first wall 81 and the second wall 82 are in contact with the facing main films 71 and 72 respectively.

The third wall 83 and the fourth wall 84 face in the X direction. The third wall 83 and the fourth wall 84 intersect the first wall 81 and the second wall 82. In the present embodiment, the third wall 83 and the fourth wall 84 are orthogonal to the first wall 81 and the second wall 82, respectively. The third wall 83 and the fourth wall 84 define the side surfaces of the wall surfaces forming the interior space of the exterior body 80. The third wall 83 and the fourth wall 84 are also referred to as a first side wall 83 and a second side wall 84. The fifth wall 85 is a wall coupled to the first wall 81 to the fourth wall 84. The fifth wall 85 defines an end portion in the insertion direction Di of the interior space.

In the present embodiment, the opening portion 87 is provided at a position facing the fifth wall 85. Specifically, in the present embodiment, the opening portion 87 is defined by the edge on the +Z direction side of each of the first wall 81, the second wall 82, the third wall 83, and the fourth wall 84. The opening portion 87 may be provided in a portion of the wall. For example, the exterior body 80 may have a sixth wall facing the fifth wall 85, and an opening portion 87 may be formed in a portion of the sixth wall.

FIG. 4B is a schematic view illustrating a state in a process of storing the liquid storage body 60 in the exterior body 80. As illustrated in FIG. 4B, the liquid storage body 60 is stored in the exterior body 80 while the gusset portion 76 is bent inward of the liquid storage body 60 by the pressing portions 21 and 22. Accordingly, the liquid storage body 60 is stored in the exterior body 80 in a state where the side films 73 and 74 are pressed by the pressing portions 21 and 22 and the gusset portion 76 is bent inward of the liquid storage body 60.

Figure 5A:
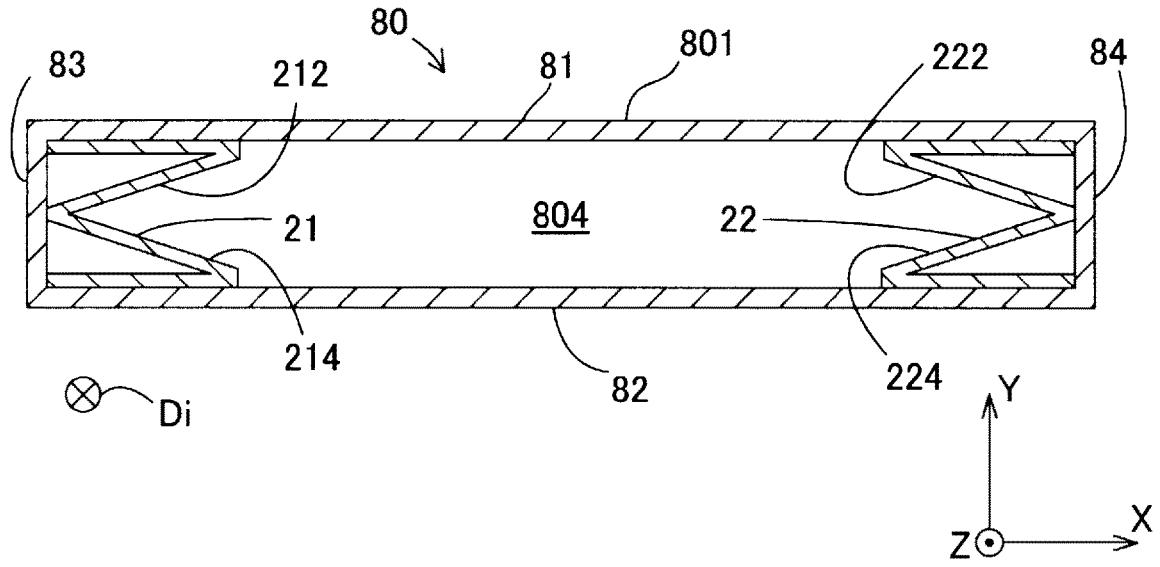
FIG. 5A is a schematic view of cross section taken along the line VA-VA in FIG. 3.

FIG. 5A is a schematic view of cross section taken along the line VA-VA in FIG. 3. Two pressing portions 21 and 22 are provided on the side walls 83 and 84 side of the interior space of the exterior body 80. One of the two pressing portions 21 and 22 disposed along the third wall 83 is referred to as a first pressing portion 21, and the other disposed along the fourth wall 84 is referred to as a second pressing portion 22. The first pressing portion 21 has a first pressing wall 212 and a second pressing wall 214 that form two wall surfaces inclined such that the distance between the first pressing portion 21 and the third wall 83 decreases. The wall surfaces of the first pressing wall 212 and the second pressing wall 214 are planar surfaces. Similarly, the second pressing portion 22 has a first pressing wall 222 and a second pressing wall 224 which form two wall surfaces inclined such that the distance between the second pressing portion 22 and the fourth wall 84 decreases. The wall surfaces of the first pressing wall 222 and the second pressing wall 224 are planar surfaces.

As described above, the thickness of a storage space 804 of the liquid storage body 60 in the exterior body 80 decreases in size in the Y direction toward the side wall 83 due to the arrangement of the pressing portions 21 and 22. In the present embodiment, the pressing portions 21 and 22 are formed separately from the main body portion 801 of the exterior body 80 and are detachable. The pressing portions 21 and 22 are separate from the main body portion 801 in the present embodiment, and may be integrally formed with the main body portion 801.

The pressing portions 21 and 22 are provided at least in a portion of the side walls 83 and 84 from one end to the other end in the Z direction. The pressing portions 21 and 22 are preferably provided at a half or more, and more preferably at three quarters or more of the side walls 83 and 84 from one end to the other end in the Z direction.

Figure 5B:
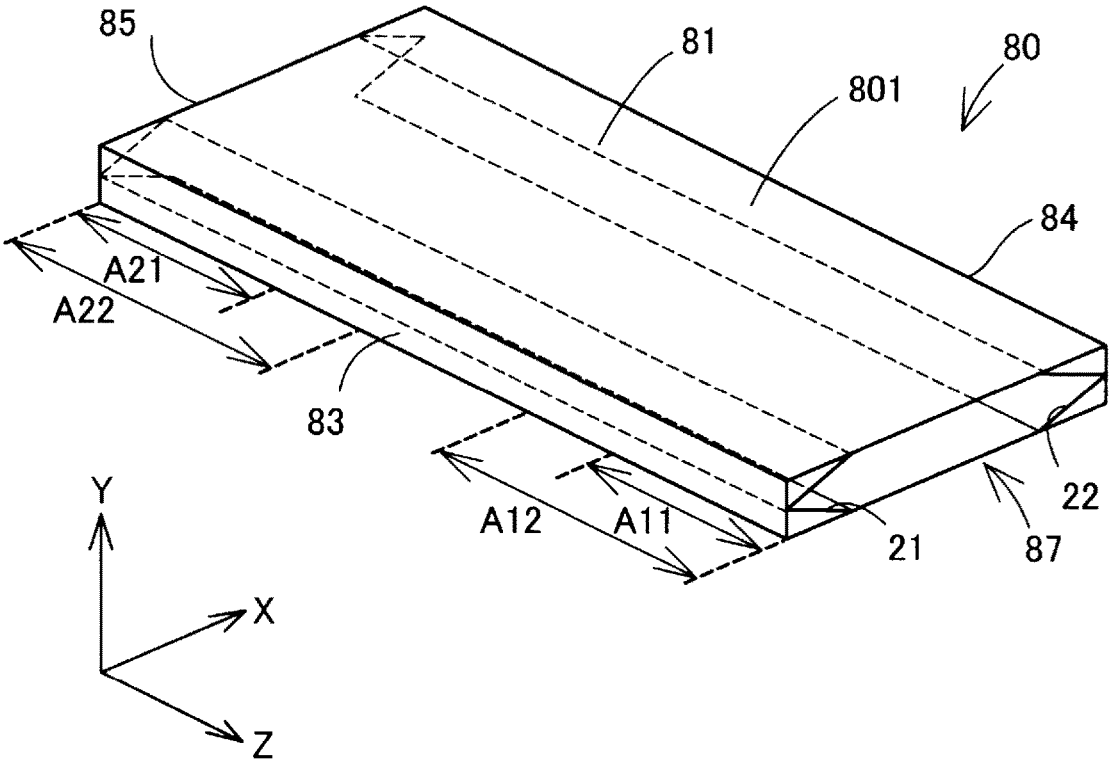
FIG. 5B is a second schematic view illustrating the exterior body of the liquid storage body.

FIG. 5B is a second schematic view of the exterior body 80. Hereinafter, a region where the pressing portion 21 is preferably provided in the exterior body 80 will be described with reference to FIG. 5B. The pressing portions 21 and 22 are preferably provided in both a range including one end and a range including the other end of the side walls 83 and 84 from one end to the other end in the Z direction. The range including one end is preferably provided continuously in a quarter range A11 starting from one end of one end to the other end, and more preferably provided continuously in a three-eighth range A12. The range including the other end is preferably provided continuously in a quarter range A21 starting from the other end of one end to the other end, and more preferably provided continuously in a three-eighth range A22. In the present embodiment, the two pressing portions 21 and 22 are provided continuously from one end to the other end in the Z direction of the side walls 83 and 84, respectively.

Figure 6:
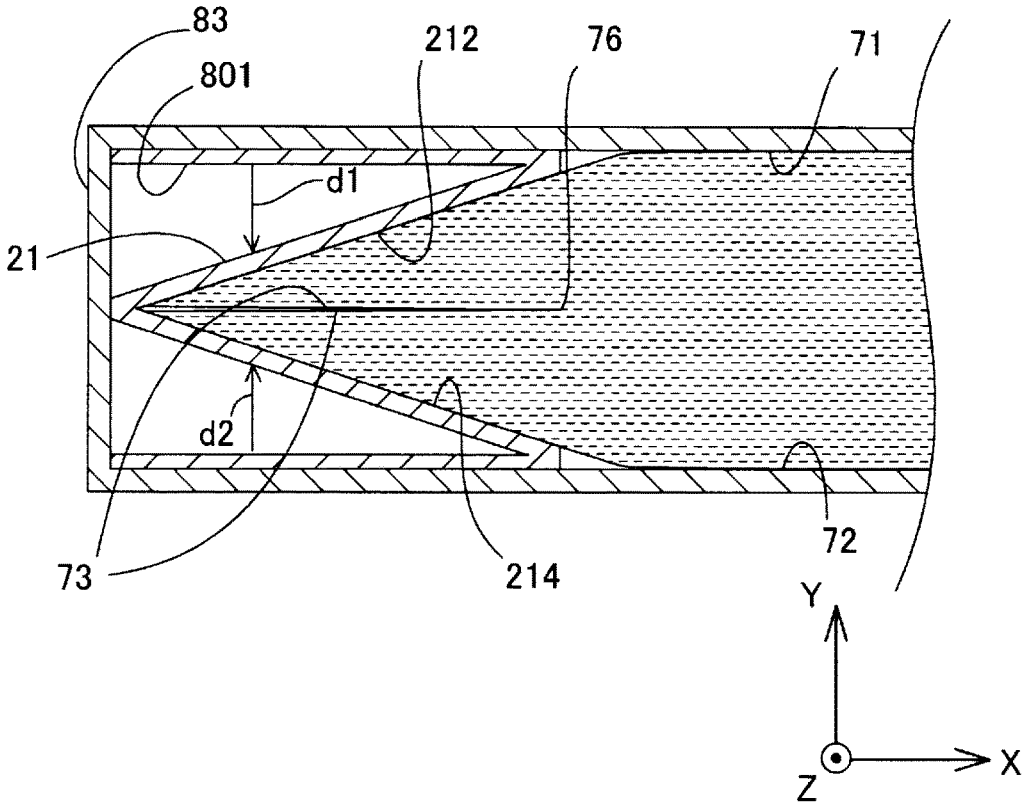
FIG. 6 is a schematic view of cross section taken along the line VI-VI in FIG. 4A.

FIG. 6 is a schematic view of cross section taken along the line VI-VI in FIG. 4A. As illustrated in FIG. 6, the first pressing portion 21 has an area having a thickness smaller than the thickness of the liquid storage body 60 before being stored in the exterior body 80. The thickness is a size in the Y direction in the present embodiment. Therefore, the pressing portions 21 and 22 press the side films 73 and 74 by interposing the two main films 71 and 72 of the liquid storage body 60 from both sides. The fact that "interpose from both sides of the main films 71 and 72" means that it is pressed from both directions of a first direction from one main film 71 to the other main film 72, and a second direction from the other main film 72 to one main film 71. In the present embodiment, the first direction and the second direction are pressing directions d1 and d2 illustrated in FIG. 6. The side films 73 and 74 of the liquid storage body 60 are pressed by the pressing portion 21 in the pressing directions d1 and d2 intersecting with the main films 71 and 72. By pressing the side films 73 and 74 of the liquid storage body 60, the liquid storage body 60 is stored in the exterior body 80 in a state where the gusset portion 76 is bent inward.

In the state where the gusset portion 76 is bent inward, it is preferable that the distance between one main film 71 side and the other main film 72 side of each of the bent side films 73 and 74 is small. The one main film 71 side means one main film 71 side of the side films 73 and 74 from the gusset portion 76. In addition, the other main film 72 side means the main 72 side of the side films 73 and 74 from the gusset portion 76. The distance between one main film 71 side and the other main film 72 side is the distance in the Y direction. The standard of the thickness of the liquid storage body 60 is the thickness of the liquid storage body 60 before being stored in the exterior body 80. In addition, as long as the gusset portion 76 is bent, even when the gusset portions 76 are not completely bent, there may be a blank portion therebetween to some extent. Even in this case, the possibility that the gusset portion 76 is cracked by an external impact can be reduced. The degree of the blank portion capable of reducing the occurrence of cracks, that is, the inclined angle of the bent side films 73 and 74 with respect to the X direction is preferably different depending on the volume of the liquid stored in the liquid storage body 60, the heights of the side films 73 and 74 in the Y direction, and the like.

According to the first embodiment described above, when the side films 73 and 74 are pressed by the pressing portions 21 and 22, the gusset portion 76 is bent inward. Therefore, the liquid storage body 60 is stored in the exterior body 80 in a state where the gusset portion 76 is bent inward. As a result, even when the exterior body 80 shakes during transport or the like, deformation such as bending to the inner side and bending to the outer side of the gusset portion 76 are suppressed. Therefore, fatigue due to repeated bending in the gusset portion 76, which may cause breakage of the liquid storage body 60, is reduced. Furthermore, the possibility that the gusset portion 76 is cracked by contacting the side wall of the exterior body 80 facing the gusset portion 76 can be reduced.

In addition, according to the first embodiment described above, the pressing portions 21 and 22 are provided at a half or more of one end to the other end in the Z direction, which is the depth direction of the side walls 83 and 84. Therefore, even when an impact is applied to the liquid storage body 60 from the outside of the exterior body 80 due to falling or the like, concentration of stress generated by rapid flow of liquid in a narrow region of the liquid storage body 60 can be suppressed. Therefore, when the impact is applied to the liquid storage body 60 from the outside of the exterior body 80, the possibility of breakage of the liquid storage body 60 can be reduced. The effect of reducing the possibility of breakage of the liquid storage body 60 is further enhanced when the pressing portions 21 and 22 are provided in a wide range from one end to the other end in the Z direction, which is the depth direction of the side walls 83 and 84.

In addition, according to the first embodiment described above, the pressing portions 21 and 22 are provided in both the range including one end and the range including the other end of the side walls 83 and 84 from one end to the other end in the Z direction. Therefore, compared with the center of the gusset portion 76, the pressing portions 21 and 22 can efficiently suppress the breakage on one end side and the other end side of the gusset portion 76 which is likely to be broken by accumulation of impact and fatigue.

B. Second Embodiment

A second embodiment differs from the first embodiment in that an exterior body 380 has a structure that can be attached to the attachment portion 30 of the liquid discharge apparatus 100 illustrated in FIG. 1 with the liquid storage body 60 stored therein. In the present embodiment, the liquid storage body 60 is inserted from the opening portion 87 such that the liquid discharge portion 62 is located on the fifth wall 85 side. In the following, the same components as those of the first embodiment are denoted by the same reference numerals, and detailed description thereof is not repeated.

Figure 7:
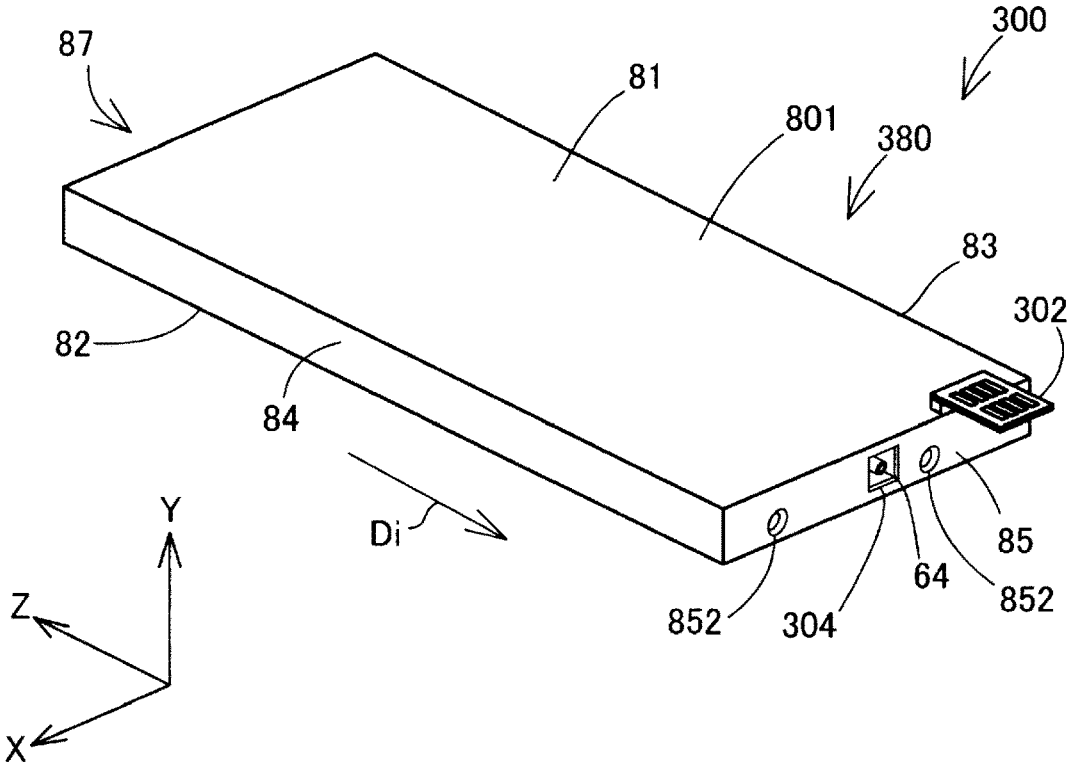
FIG. 7 is a schematic view illustrating an appearance of a liquid storage body unit according to a second embodiment.

FIG. 7 is a schematic view illustrating an appearance of a liquid storage body unit 300 according to the second embodiment. In the present embodiment, the liquid storage body 60 is not directly attached to the attachment portion 30 of the liquid discharge apparatus 100, and is attached in the state of the liquid storage body unit 300 stored in the exterior body 380 illustrated in FIG. 7. The exterior body 380 has an adapter portion 302 on at least one of the plurality of walls 81 to 85, which is the fifth wall 85 in the present embodiment, and functions as a liquid storage container 601. The adapter portion 302 has a contact terminal substrate capable of electrically connecting the liquid discharge apparatus 100 with the liquid storage body 60 to each other. The liquid discharge apparatus 100 acquires information on attachment and detachment of the liquid storage body 60 and the liquid storage body 60 via the adapter portion 302. In addition, in the liquid storage body unit 300, the fifth wall 85 is provided with a connecting opening portion 304 for coupling the liquid outlet 64 to the outside of the exterior body 380 and enabling the liquid to be discharged. In addition, the fifth wall 85 of the exterior body 380 is provided with a positioning hole 852 for determining the position at the time of being attached to the liquid discharge apparatus 100.

According to the second embodiment described above, the same effects can be obtained in that the configuration is the same as that of the first embodiment. Furthermore, according to the second embodiment, the exterior body 380 has the adapter portion 302 on at least one of the plurality of walls 81 to 85, and functions as a cartridge. Therefore, the exterior body 380 can be attached to the liquid discharge apparatus 100 in the state of the liquid storage body unit 300 in which the liquid storage body 60 is stored. Therefore, when the user attaches the liquid storage body 60 to the liquid discharge apparatus 100, it is possible to save the trouble of taking out the liquid storage body 60 from the exterior body 380.

C. Other Embodiments

C1. First Other Embodiment

In the above embodiment, although the exterior body 80 is formed using the cardboard, it is not limited thereto. For example, the exterior body 80 may be formed of paper other than the cardboard, specifically, for example, a thick paper. In addition, the exterior body 80 may be formed of a material other than the paper, for example, a resin. In addition, although the main body portion 801 and the pressing portions 21 and 22 are formed using the same raw material, it is not limited thereto. For example, the main body portion 801 may be formed of the resin, and the pressing portions 21 and 22 may be formed of the cardboard.

C2. Second Other Embodiment

In the above embodiment, the liquid storage body 60 is formed of four films, a pair of main films 71 and 72 and two sheets of side films 73 and 74, and the number of films forming the liquid storage body 60 is not limited to four sheets. For example, the liquid storage body 60 may be formed of less than four films, specifically, for example, three films. In this case, the liquid storage body 60 may be, for example, a so-called standing pouch type bag formed of a pair of main films and a side film having a gusset portion 76. In this case, only one pressing portion may be provided on the exterior bodies 80 and 380. In addition, for example, the number of liquid storage bodies 60 may be five sheets or more. Specifically, for example, the liquid storage body 60 may be formed of five sheets of films. In this case, for example, it may be a bag-like container formed of a pair of main films and three sheets of side films having a gusset portion 76. In this case, three pressing portions may be provided on the exterior bodies 80 and 380.

C3. Third Other Embodiment

In the above embodiment, although the pressing portions 21 and 22 are continuously provided from one end to the other end in the insertion direction Di of the side walls 83 and 84, it is not limited thereto. For example, the pressing portions 21 and 22 may be provided intermittently from one end to the other end. In addition, the pressing portions 21 and 22 may be provided in a portion from one end to the other end.

C4. Fourth Other Embodiment

In the above embodiment, although the pressing portions 21 and 22 have a shape in which the heights from each of the main films 71 and 72 decrease, as approaching the side walls 83 and 84, it is not limited to this shape. For example, the pressing portions 21 and 22 may have a step shape in which the height changes discontinuously. In addition, in the above embodiment, the wall surfaces of the first pressing walls 212 and 222 and the second pressing walls 214 and 224 having the pressing portions 21 and 22 are plane surfaces. However, the wall surfaces of the first pressing walls 212 and 222 and the second pressing walls 214 and 224 may not be plane surfaces. For example, the wall surfaces of the first pressing walls 212 and 222 and the second pressing walls 214 and 224 may have a curved shape in which the distance decreases as approaching the side walls 83 and 84. In addition, in the above embodiment, although the pressing portions 21 and 22 are pressed by the shape, it is not limited thereto. An elastic member is provided having elasticity in a direction intersecting with the main films 71 and 72, and the side films 73 and 74 may be pressed by the elastic member.

C5. Fifth Other Embodiment

In the above embodiment, although the exterior bodies 80 and 380 are provided with the opening portion, these may not be provided. In this case, when the liquid storage body 60 is taken out from the exterior body 80, a portion of the exterior bodies 80 and 380 may have an openable area. In addition, in the above embodiment, although the opening portions of the exterior bodies 80 and 380 are normally open state, it is not limited thereto. For example, a lid-like opening and closing structure may be provided at the opening portion of the exterior bodies 80 and 380.

C6. Sixth Other Embodiment

In the above second embodiment, the exterior body 380 inserted into the liquid discharge apparatus 100 and functioning as the liquid storage container 601 has the adapter portion 302. However, the exterior body 380 may not have the adapter portion 302 even when the adapter portion 302 has a function as the liquid storage container 601. For example, the exterior body 380 may have a structure in which the liquid discharge portion 62 of the liquid storage body 60 stored inside is exposed when the liquid storage body 60 has an adapter portion. In this case, even when the exterior body 380 does not have the adapter portion 302, the liquid storage body 60 and the liquid discharge apparatus 100 can be connected each other using the adapter portion of the liquid storage body 60 exposed from the exterior body 380.

C7. Seventh Other Embodiment

In the above first embodiment and the second embodiment, the first pressing portion 21 and the second pressing portion 22 have the first pressing walls 212 and 222 and the second pressing walls 214 and 224. One of the pressing walls 212 and 222 and the second pressing walls 214 and 224 may be functioned by the outer shell. For example, in the first pressing portion 21 illustrated in FIG. 5A, when the second pressing wall 214 is omitted, the third wall 83 side end portion of the first pressing wall 212 is disposed closer to the second wall 82 side, and the second wall 82 forming the outer shell is made to function as the second pressing wall 214. That is, by interposing the two main films 71 and 72 from both sides by the first pressing wall 212 and the second wall 82, the side film 73 is pressed and the gusset portion 76 is bent inward.

Even in the first to seventh other embodiments described above, similar effects can be obtained in that these have the same configuration as that of the first embodiment or the second embodiment.

C8. Eighth Other Embodiment

The present disclosure is applicable not only to the ink jet printer and the ink tank for supplying ink to the ink jet printer, but also to any liquid discharge apparatus discharging various liquids including ink, and the liquid tank for containing the liquid. For example, the present disclosure is applicable to the following various liquid discharge apparatus and liquid tanks thereof.

(1) Image recording apparatus such as facsimile machine (2) Color material discharge apparatus used for manufacturing a color filter for an image display device such as a liquid crystal display (3) Electrode material discharge apparatus used for forming an electrode of organic electro luminescence (EL) display, field emission display (FED) or the like (4) Liquid discharge apparatus discharging liquid containing biological organic matter used in biochip manufacturing (5) Sample discharge apparatus as precision pipette (6) Lubricant discharge apparatus (7) Discharge apparatus for resin liquid (8) Liquid discharge apparatus discharging lubricating oil at a pinpoint for precision machines such as a watch and a camera (9) Liquid discharge apparatus discharging a transparent resin liquid such as an ultraviolet curable resin liquid onto a substrate to form a micro hemispherical lens (optical lens) or the like used for an optical communication element or the like

(10) Liquid discharge apparatus discharging an acidic or alkaline etching solution to etch a substrate or the like

(11) Liquid discharge apparatus provided with a liquid discharge head discharging droplets of any other minute amount.

The "droplet" refers to a state of the liquid discharged from the liquid discharge apparatus, and includes granular, teardrop-like, and threadlike tails. In addition, the "liquid" referred to here may be any material that can be discharged by the liquid discharge apparatus. For example, "liquid" may be a material in a state when the substance is in liquid phase, and the substance with high or low viscosity in liquid state, and the substance in liquid state such as sol, gel water, other inorganic solvents, organic solvents, solutions, liquid resins, liquid metals (metal melts) are also included in the "liquid". In addition, not only the liquid as one state of the material, but also those obtained by dissolving, dispersing or mixing particles of functional materials consisting of solid matter such as pigment and metal particles in a solvent are included in the "liquid". In addition, typical examples of the liquid include the ink described in the above embodiment, liquid crystal, and the like. Here, the ink includes general aqueous inks and oil-based inks, and various liquid compositions such as gel inks and hot melt inks.

The present disclosure is not limited to the above-described embodiment, and can be implemented in various configurations without departing from the scope of the present disclosure. For example, the technical features of the embodiment corresponding to the technical features in the respective aspects described in the section of the summary of the disclosure can be appropriately replaced or combined to solve some or all of the problems described above, or to achieve some or all of the effects described above. In addition, if the technical features are not described as essential in the present specification, these can be deleted as appropriate.

(1) According to an aspect of the present disclosure, there is provided an exterior body for storing a liquid storage body including a first main film, a second main film, and a first side film that define an interior space containing a liquid, the first side film including a gusset portion having a fold, and the first main film having a first main surface, the second main film having a second main surface, and the first main surface facing the second main surface via the liquid. The exterior body is provided with an outer shell that forms a storage space storing the liquid storage body, and a pressing portion that is provided in the outer shell, that presses the first side film by interposing the first and second main films from both sides, and that bend the gusset portion inward. According to the exterior body of this aspect, the gusset portion is bent inward by the side film being pressed by the pressing portion. Therefore, the liquid storage body is stored in the exterior body in a state where the gusset portion is bent inward. As a result, even when the exterior body sways during transport or the like, deformation such as bending to the inside and bending to the outside of the gusset portion is suppressed. Therefore, fatigue due to repeated bending in the gusset portion, which may cause breakage of the liquid storage body, is reduced.

(2) According to another aspect of the present disclosure, there is provided an exterior body for storing a liquid storage body including a first main film, a second main film, and a first side film that define an interior space containing a liquid, the first side film including a gusset portion having a fold, and the first main film having a first main surface, the second main film having a second main surface, and the first main surface facing the second main surface via the liquid. The exterior body includes an outer an outer shell that forms a storage space storing the liquid storage body, the outer shell including (i) a first side wall facing the first side film when the liquid storage body is stored, (ii) a first wall intersecting the first side wall, and constituting a main surface of the exterior body, and (iii) a second wall intersecting the first side wall, facing the first wall, and constituting another main surface of the exterior body, and a pressing portion that is provided in the outer shell, and that forms an area smaller than a length of the liquid storage body before being stored in the exterior body in a Y direction which is defined as an opposite direction of the first wall and the second wall, in which the pressing portion includes a first pressing wall and a second pressing wall, which define the area, for pressing the first side film by interposing the first and second main films from both sides. According to the exterior body of this aspect, the gusset portion is bent inward by the side film being pressed by the pressing portion. Therefore, the liquid storage body is stored in the exterior body in a state where the gusset portion is bent inward. As a result, even when the exterior body sways during transport or the like, deformation such as bending to the inside and bending to the outside of the gusset portion is suppressed. Therefore, fatigue due to repeated bending in the gusset portion, which may cause breakage of the liquid storage body, is reduced.

(3) The exterior body of the above aspect may further include a second side wall that faces the first side wall, and an opening portion configured to insert the liquid storage body therethrough, in which an opening direction of the opening portion may be a Z direction perpendicular to the Y direction which is the opposite direction, and to an X direction where the first side wall and the second side wall face each other. According to the exterior body of this aspect, the pressing portion is continuously provided from one end to the other end of the side wall in the Z direction. Therefore, even when an impact is applied to the liquid storage body from the outside of the exterior body due to falling or the like, it is possible to suppress concentration of stress in a narrow region of the liquid storage body. Therefore, the possibility of breakage of the liquid storage body can be reduced when the impact is applied to the liquid storage body from the outside of the exterior body.

(4) The exterior body of the above aspect may further include a second side wall that faces the first side wall, in which a first distance between the first pressing wall and the second pressing wall in the Y direction which is the opposite direction may be shorter than a second distance between the pressing wall and the second pressing wall in the Y direction which is the opposite direction, and a location of the first distance is closer to the first side wall than is a location of the second distance, and the first pressing wall and the second pressing wall may be provided continuously from one end to another end of the first side wall in a Z direction perpendicular to the Y direction and to the X direction where the first side wall and the second side wall face each other, respectively. According to the exterior body of this aspect, the pressing portion is continuously provided from one end to the other end of the side wall in the Z direction. Therefore, even when an impact is applied to the liquid storage body from the outside of the exterior body due to falling or the like, it is possible to suppress concentration of stress in a narrow region of the liquid storage body. Therefore, the possibility of breakage of the liquid storage body can be reduced when the impact is applied to the liquid storage body from the outside of the exterior body.

(5) The exterior body of the above aspect may further include an opening portion configured to insert the liquid storage body therethrough, in which an opening direction of the opening portion may be the Z direction. According to the exterior body of this aspect, since the opening portion is provided, insertion of the liquid storage body into the exterior body is easy.

(6) In the exterior body of the above aspect, the exterior body may be made of paper. According to the exterior body of this aspect, a cost in processing can be reduced as compared with the case where the exterior body is formed using the materials other than paper, such as resin.

(7) In the exterior body of the above aspect, the liquid storage body may include a second side film having another gusset portion, and the exterior body may further include a first pressing portion for pressing one of the first and second side films, and a second pressing portion for pressing another of the first and second side films. According to this aspect, when storing the liquid storage body having two gusset portions, the exterior body may press both of the two gusset portions.

(8) In the exterior body of the above aspect, the liquid storage body may supply the liquid stored in the interior space to a liquid discharge apparatus, and the exterior body may include an adapter portion configured to electrically connect the liquid discharge apparatus and the liquid storage body to each other. According to the exterior body of this aspect, the liquid storage body may be connected with the liquid discharge apparatus without taking out the liquid storage body from the exterior body.

(9) According to still another aspect of the present disclosure, there is provided a liquid storage body unit attached to a liquid discharge apparatus. The liquid storage body unit of this aspect includes the exterior body according to the above aspect, and a liquid storage body including a first main film, a second main film, and a first side film that define an interior space containing a liquid, the first side film including a gusset portion having a fold, and the first main film having a first main surface, the second main film having a second main surface, and the first main surface facing the second main surface via the liquid. According to the liquid storage body unit of this aspect, since the exterior body of the above aspect is provided, when the side film of the liquid storage body is pressed by the pressing portion, the gusset portion is bent inward. Therefore, the liquid storage body is stored in the exterior body in a state where the gusset portion is bent inward. As a result, even when the exterior body sways during transport or the like, deformation such as bending to the inside and bending to the outside of the gusset portion is suppressed. Therefore, fatigue due to repeated bending in the gusset portion, which may cause breakage of the liquid storage body, is reduced.

(10) According to still another aspect of the present disclosure, there is provided a liquid discharge apparatus discharging a liquid to a medium. The liquid discharge apparatus includes the liquid storage body unit the above aspect, and a liquid discharge head that discharges, to the medium, the liquid contained in the liquid storage body unit. According to the exterior body of this aspect, the liquid storage body may be coupled to the liquid discharge apparatus in the state of the liquid storage body unit without taking out the liquid storage body from the exterior body. Therefore, the effort which takes out the liquid storage body from the exterior body is reduced.

The present disclosure may also be realized in various forms other than the exterior body, the liquid storage body unit, and the liquid discharge apparatus. For example, it can be realized in the form of a method of manufacturing the exterior body or the liquid storage body unit.

What is claimed is:

1. An exterior body for storing a liquid storage body including a first main film, a second main film, and a first side film that define an interior space containing a liquid, the first side film including a gusset portion having a fold with two portions of the first side film located on opposite sides of the fold, the first main film having a first main surface, the second main film having a second main surface, and the first main surface facing the second main surface via the liquid, the exterior body comprising:

an outer shell that forms a storage space storing the liquid storage body; and a pressing portion that is provided in the outer shell, that presses the first side film by interposing the first and second main films from both sides, and that bends the gusset portion inward and presses the two portions of the first side film closer together.

2. The exterior body according to claim 1, wherein the exterior body is made of paper.

3. The exterior body according to claim 1, wherein the liquid storage body includes a second side film having another gusset portion, and the exterior body further comprises:

a first pressing portion for pressing one of the first and second side films; and a second pressing portion for pressing another of the first and second side films.

4. The exterior body according to claim 1, wherein the liquid storage body includes a supply port configured to supply the liquid stored in the interior space to a liquid discharge apparatus, and the exterior body further comprises:

an adapter portion configured to electrically connect the liquid discharge apparatus with the liquid storage body each other.

5. A liquid storage body unit attached to a liquid discharge apparatus, the liquid storage body unit comprising:

the exterior body according to claim 1; and the liquid storage body.

6. A liquid discharge apparatus discharging a liquid to a medium, the liquid discharge apparatus comprising:

the liquid storage body unit according to claim 5; and a liquid discharge head that discharges, to the medium, the liquid contained in the liquid storage body unit.

7. An exterior body for storing a liquid storage body including a first main film, a second main film, and a first side film that define an interior space containing a liquid, the first side film including a gusset portion having a fold, the first main film having a first main surface, the second main film having a second main surface, and the first main surface facing the second main surface via the liquid, the exterior body comprising:

an outer shell that forms a storage space storing the liquid storage body, the outer shell including (i) a first side wall facing the first side film when the liquid storage body is stored, (ii) a first wall intersecting the first side wall, and constituting a main surface of the exterior body, and (iii) a second wall intersecting the first side wall, facing the first wall, and constituting another main surface of the exterior body; and a pressing portion that is provided in the outer shell, and that forms an area smaller than a length of the liquid storage body before being stored in the exterior body in a Y direction which is defined as an opposite direction of the first wall and the second wall, wherein the pressing portion includes a first pressing wall and a second pressing wall, which define the area, for pressing the first side film by interposing the first and second main films from both sides.

8. The exterior body according to claim 7, further comprising:

a second side wall that faces the first side wall; and an opening portion configured to insert the liquid storage body therethrough, wherein an opening direction of the opening portion is a Z direction perpendicular to the Y direction which is the opposite direction, and to an X direction where the first side wall and the second side wall face each other.

9. The exterior body according to claim 7, further comprising:

a second side wall that faces the first side wall, wherein a first distance between the first pressing wall and the second pressing wall in the Y direction which is the opposite direction is shorter than a second distance between the pressing wall and the second pressing wall in the Y direction which is the opposite direction, and a location of the first distance is closer to the first side wall than is a location of the second distance, and the first pressing wall and the second pressing wall are provided continuously from one end to another end of the first side wall in a Z direction perpendicular to the Y direction and to the X direction where the first side wall and the second side wall face each other, respectively.

10. The exterior body according to claim 9, further comprising:

an opening portion configured to insert the liquid storage body therethrough, wherein an opening direction of the opening portion is the Z direction.

* * * * *